US008351818B2

(12) United States Patent
Hayakawa et al.

(10) Patent No.: US 8,351,818 B2
(45) Date of Patent: Jan. 8, 2013

(54) IMAGE FORMING APPARATUS AND METHOD OF CONTROLLING IMAGE FORMING APPARATUS

(75) Inventors: Masahiko Hayakawa, Ama-gun (JP); Kazushi Fukuta, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 415 days.

(21) Appl. No.: 12/624,983

(22) Filed: Nov. 24, 2009

(65) Prior Publication Data

US 2010/0129108 A1 May 27, 2010

(30) Foreign Application Priority Data

Nov. 26, 2008 (JP) ..... 2008-300605

(51) Int. Cl.
*G03G 21/00* (2006.01)

(52) U.S. Cl. ..... 399/98

(58) Field of Classification Search ..... 399/98, 399/99, 314, 315
See application file for complete search history.

(56) References Cited

U.S. PATENT DOCUMENTS

| | | | |
|---|---|---|---|
| 5,119,144 A | 6/1992 | Hada et al. | |
| 5,506,669 A | 4/1996 | Inoue et al. | |
| 2007/0036578 A1 * | 2/2007 | Fukami et al. | 399/101 |

FOREIGN PATENT DOCUMENTS

| | | |
|---|---|---|
| JP | 62-138880 | 6/1987 |
| JP | 02-039186 | 2/1990 |
| JP | 02-212866 | 8/1990 |
| JP | 05-094118 | 4/1993 |
| JP | 07-044079 | 2/1995 |
| JP | 07-261565 | 10/1995 |
| JP | 10-319735 A | 12/1998 |
| JP | 11-052664 | 2/1999 |
| JP | 2001-272865 | 10/2001 |
| JP | 2002-214929 A | 7/2002 |
| JP | 2005-189687 A | 7/2005 |

OTHER PUBLICATIONS

Notification of Reasons for Refusal dispatched Oct. 26, 2010 in Japanese Patent Application No. 2008-300605 and English translation thereof.

JP Office Action dtd Jan. 25, 2011, JP Appln. 2008-300605, English Translation.

* cited by examiner

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming apparatus includes: a belt having a carrying surface that carries a recording sheet; a photosensitive body disposed opposite to the carrying surface of the belt; a transferring member which is disposed opposite to the photosensitive body such that the carrying surface of the belt is disposed between the transferring member and the photosensitive body, and a transferring bias is applied to the transferring member; a cleaning member arranged adjacent to an outer peripheral surface of the belt; and a control unit for controlling a voltage that is applied to the cleaning member. The control unit causes a first voltage to be applied to the cleaning member during a first mode. The control unit causes a second voltage, different from the first voltage, to be applied to the cleaning member during a second mode.

11 Claims, 11 Drawing Sheets

FIG. 13

| | | ELECTRIC CURRENT | | | |
|---|---|---|---|---|---|
| | | 0~A1 | A1~A2 | A2~A3 | A3~A4 |
| HUMIDITY | 0~H1 | −V11 | −V11 | −V12 | −V13 |
| | H1~H2 | −V11 | −V12 | −V13 | −V14 |
| | H2~H3 | −V12 | −V13 | −V14 | −V15 |
| | H3~H4 | −V13 | −V14 | −V15 | −V16 |

IMAGE FORMING APPARATUS AND METHOD OF CONTROLLING IMAGE FORMING APPARATUS

CROSS REFERENCE TO RELATED APPLICATION

The present application claims priority from Japanese Patent Application No. 2008-300605, which was filed on Nov. 26, 2008, the disclosure of which is incorporated herein by reference in its entirety.

BACKGROUND

The present invention relates to an image forming apparatus for making a printing on a recording sheet that is carried by a belt, and a method of controlling the image forming apparatus.

A related image forming apparatus equipped with a belt for carrying a recording sheet, a photosensitive drum for printing on a recording sheet on the belt, and a cleaning member to which a predetermined voltage is applied to recover toner adhered to an outer peripheral surface of the belt, etc. has been described. Specifically, according to this related art, the same voltage applied at a time of cleaning (recovering the toner, etc.) is applied to the cleaning member to smooth or level a distribution of charges, which accumulate unevenly on the surface of the belt.

BRIEF SUMMARY

However, when the voltage applied to the cleaning member is set to a low voltage to effectively recover the toner, the distribution of charges, which accumulate unevenly on the belt can not be made satisfactorily smooth. Further, when a paper is put on the portion of the belt where the charges have accumulated unevenly in such a situation that the distribution of charges on the belt has not been made satisfactorily smooth, an electric discharge (so-called release discharge) is caused between the belt and the paper when the paper is released from the belt and a toner image on the paper can be disturbed. Conversely, when the voltage applied to the cleaning member is set to a high enough voltage that the distribution of charges on the belt can be properly made smooth, the a high voltage is always applied to the belt and thus the belt becomes degraded.

Therefore, an object of embodiments of the present invention is to provide an image forming apparatus capable of smoothing a distribution of charges on a belt and doing a satisfactory cleaning, while also suppressing degradation of a belt, and a method of controlling the image forming apparatus.

In order to solve the above problems, embodiments of the present invention provide an image forming apparatus, which includes a belt having a carrying surface that carries a recording sheet; a photosensitive body disposed opposite to the carrying surface of the belt; a transferring member which is disposed opposite to the photosensitive body such that the carrying surface of the belt is disposed between the transferring member and the photosensitive body, and a transferring bias is applied to the transferring member; a cleaning member arranged adjacent to an outer peripheral surface of the belt; and a control unit for controlling a voltage that is applied to the cleaning member; wherein the control unit causes a first voltage to be applied to the cleaning member during a first mode, and wherein the control unit causes a second voltage, which is different from the first voltage, to be applied to the cleaning member during a second mode.

Further, embodiments of the present invention provides a method of controlling an image forming apparatus which comprises a belt having a carrying surface; a photosensitive body disposed opposite to the carrying surface of the belt; a first transferring member which is disposed opposite to the photosensitive body such that the carrying surface of the belt is disposed between the first transferring member and the photosensitive body, and a transferring bias is applied to the first transferring member; a cleaning member arranged adjacent to an outer peripheral surface of the belt; and a control unit for controlling a voltage that is applied to the cleaning member, the method comprising:

receiving a printing command;

starting a smoothing mode in which the control unit causes a voltage to be applied to the cleaning member after a predetermined time has elapsed since reception of the printing command;

initiating printing after starting the smoothing mode;

terminating the smoothing mode after the printing ends; and executing a cleaning mode in which the control unit causes a voltage, different from the voltage of the smoothing mode, to be applied to the cleaning member.

BRIEF DESCRIPTION OF THE DRAWINGS

FIG. 13 is a view showing a table that is used to decide a voltage in the cleaning mode based on an electric current and humidity.

DETAILED DESCRIPTION OF EXEMPLARY EMBODIMENTS

Figure 1:
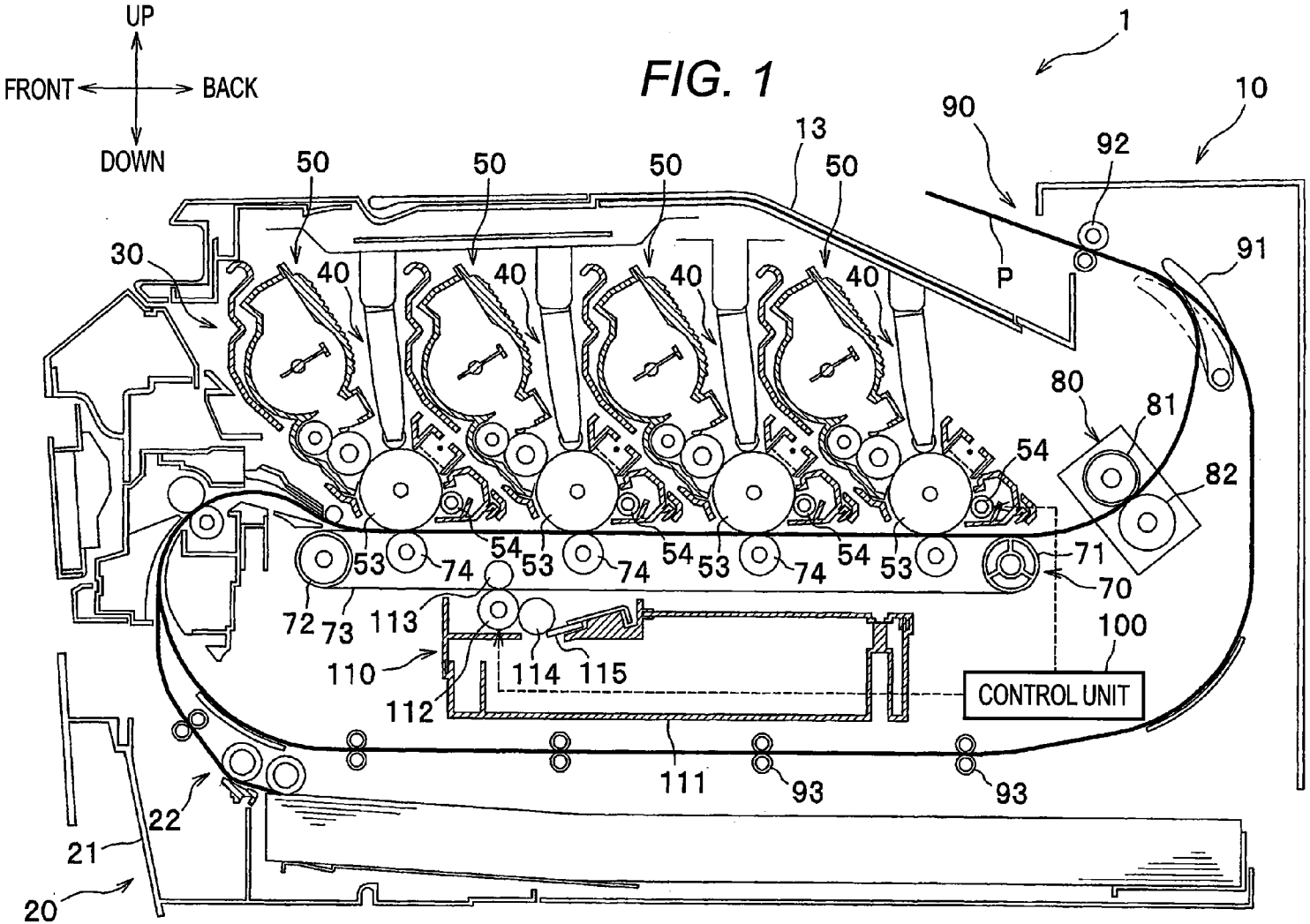
FIG. 1 is a sectional view showing an overall configuration of a color printer as an example of an image forming apparatus.
Figure 2:
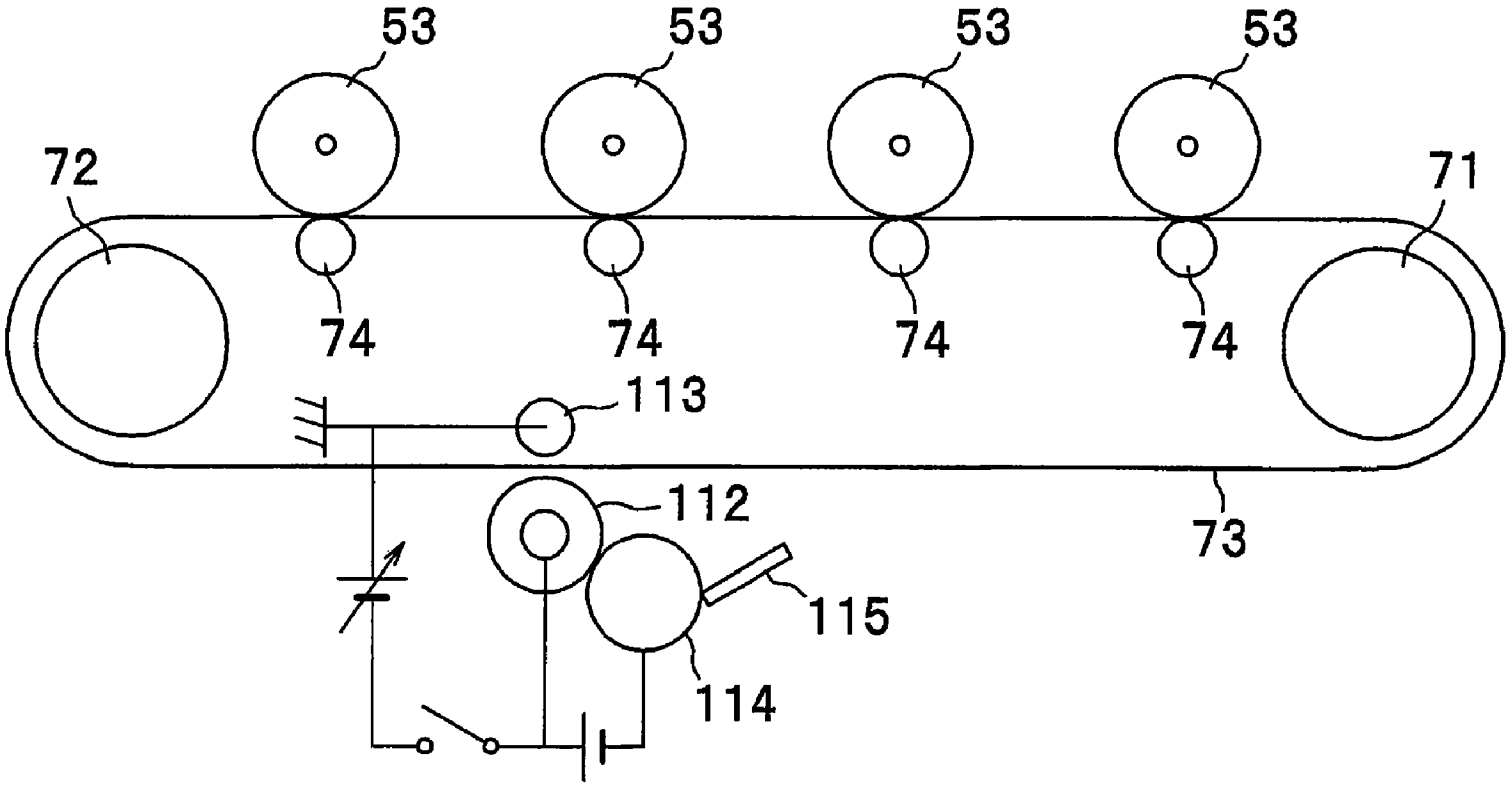
FIG. 2 is a diagram showing a circuit for applying a voltage to a cleaning roller.

Next, exemplary embodiments of the present invention will now be explained in detail with reference to the figures. Of the referenced figures, FIG. 1 is a sectional view showing an overall configuration of a color printer as an example of an image forming apparatus, and FIG. 2 is a diagram showing a circuit for applying a voltage to a cleaning roller. In the following explanation, the whole configuration of a color printer will first be explained, and details of the exemplary embodiments of the present invention will then be explained.

In the following explanation, directions are explained with respect to the position of the user who uses the color printer. More particularly, in FIG. 1, the left side as one faces FIG. 1 is assumed as the "front side (this side)", the right side as one faces FIG. 1 is assumed as the "rear side (back side)", the back side as one faces FIG. 1 is assumed as the "left side", and the back side as one faces FIG. 1 is assumed as the "right side". Also, the longitudinal direction as one faces FIG. 1 is assumed to be the "vertical direction".

As shown in FIG. 1, a color printer 1 is equipped with a paper feeding portion 20 for feeding a paper P (an example of the recording sheet), an image forming portion 30 for forming an image on the fed paper P, a paper ejecting portion 90 for ejecting the paper P on which the image is formed, and a control unit 100 in an apparatus main body 10.

The paper feeding portion 20 has a paper feed tray 21 that is provided to the bottom of the apparatus main body 10 and is fitted detachably to the apparatus main body 10, and a paper feeding mechanism 22 that carries the paper P from the paper feed tray 21 to the image forming portion 30. In the paper feeding portion 20, the paper P in the paper feed tray 21 is separated sheet by sheet by the paper feeding mechanism 22 and fed to the image forming portion 30.

The image forming portion 30 is constructed mainly by four LED units 40, four process cartridges 50, a transfer unit 70, a cleaning portion 110, and a fixing unit 80.

The LED unit 40 is constructed to include a plurality of LEDs that expose a photosensitive drum 53 described later.

The process cartridge 50 constructed to include the photosensitive drum 53 is disposed opposite to an upper surface (carrying surface) of a belt 73 described later. A publicly known charger, a developing roller, a toner container, etc., are also shown without a reference numeral. A drum cleaner 54, which temporarily holds the toner left on the photosensitive drum 53 and returns the toner to the photosensitive drum 53 at a time of cleaning operation by coming into contact with the photosensitive drum 53. A voltage is applied to the drum cleaner 54 by the control unit 100 such that the toner is held electrically and the toner is returned to the photosensitive drum 53.

The transfer unit 70 is provided between the paper feeding portion 20 and respective process cartridges 50. The transfer unit 70 includes a driving roller 71, a driven roller 72, the belt 73, and transfer rollers 74.

The driving roller 71 and the driven roller 72 are arranged in parallel at an interval in the lateral direction, and the belt 73 is formed as an endless belt and is stretched between the driving roller 71 and the driven roller 72. A surface on the upper side of the outer peripheral surface of the belt 73 acts as the carrying surface to carry the paper P, and this carrying surface comes in contact with respective transfer rollers 74. The belt 73 may be formed of material that contains Nylon as a principal component. The four transfer rollers 74are provided on the inner side of the belt 73 are disposed opposite to respective photosensitive drums 53 with the carrying surface of the belt between the transfer rollers 74 and the photosensitive drums 53. A transferring bias is applied to the transfer rollers 74 during a transferring operation by the constant current control.

The cleaning portion 110 is provided to the underside of the stretched portion of the belt 73. The cleaning portion 110 has a waste toner case 111, a cleaning roller 112 and a backup roller 113, a second cleaning roller 114, and a blade 115.

The cleaning roller 112 is arranged adjacent to the outer peripheral surface (lower surface) of the belt 73.

The backup roller 113 is arranged on the opposite side of the cleaning roller 112 with respect to the belt 73. The belt 73 is disposed between the cleaning roller 112 and the backup roller 113, and is held by these rollers.

The second cleaning roller 114 is arranged toward the back of the cleaning roller 112 and is in contact with the cleaning roller 112.

A top end of the blade 115 contacts the second cleaning roller 114. The blade 115 scrapes off the toner adhering onto the second cleaning roller 114.

The waste toner case 111 is arranged under the second cleaning roller 114. The waste toner case 111 is constructed to receive the toner that is scraped off by the second cleaning roller 114.

A bias (voltage) is applied between the backup roller 113 and the cleaning roller 112 by the control unit 100 such that the toner on the belt 73 is forced to move toward the cleaning roller 112. Specifically, as shown in FIG. 2, a negative bias compared to a potential of the backup roller 113 being grounded is applied to the cleaning roller 112, and further a negative bias whose absolute value is larger than the negative bias of the cleaning roller 112 is applied to the second cleaning roller 114. Accordingly, the toner that is recovered by the cleaning roller 112 and is positively charged is attracted to the second cleaning roller 114, and is recovered in the waste toner case 111.

The fixing unit 80 has a heating roller 81, and a pressure roller 82. The pressure roller 82 is arranged opposite to the heating roller 81 and presses against the heating roller 81.

In the image forming portion 30 constructed in this manner, first the surfaces of the photosensitive drums 53 are charged uniformly by the charger respectively, and then exposed by the LED unit 40 respectively. Accordingly, a potential of the exposed portion is lowered, and an electrostatic latent image is formed on respective photosensitive drums 53 based upon image data. Then, the toner is borne on the photosensitive drums 53 when the toner is fed to the electrostatic latent image by the developing roller.

Then, the paper P fed onto the belt 73 passes through contacting areas between the photosensitive drums 53 and the transfer rollers 74. Thus, the toner images formed on respective photosensitive drums 53 are transferred onto the paper P. Then, the paper P passes through contacting areas between the heating roller 81 and the pressure roller 82. Thus, the toner images transferred onto the paper P are thermally fixed.

The paper ejecting portion 90 includes mainly a circular-arc flapper 91 that can be swung back and forth, and a paper ejecting roller 92. The paper P ejected from the fixing unit 80 is guided by the inner peripheral surface of the flapper 91, then is ejected to the outside of the apparatus main body 10 by the paper ejecting roller 92, and then is accumulated in a paper eject tray 13. In the case of the double-side printing, when the paper P is ejected onto the paper eject tray 13 halfway by the paper ejecting roller 92, such paper P is returned to the inside of the apparatus main body 10 in response to the counter rotation of the paper ejecting roller 92 and the switching of the flapper 91, and then this paper P is fed again to the upstream side of the image forming portion 30 through the outer peripheral surface of the flapper 91 by a plurality of reverse carrying rollers 93 in a reversed state.

<Control Unit>

Figure 3:
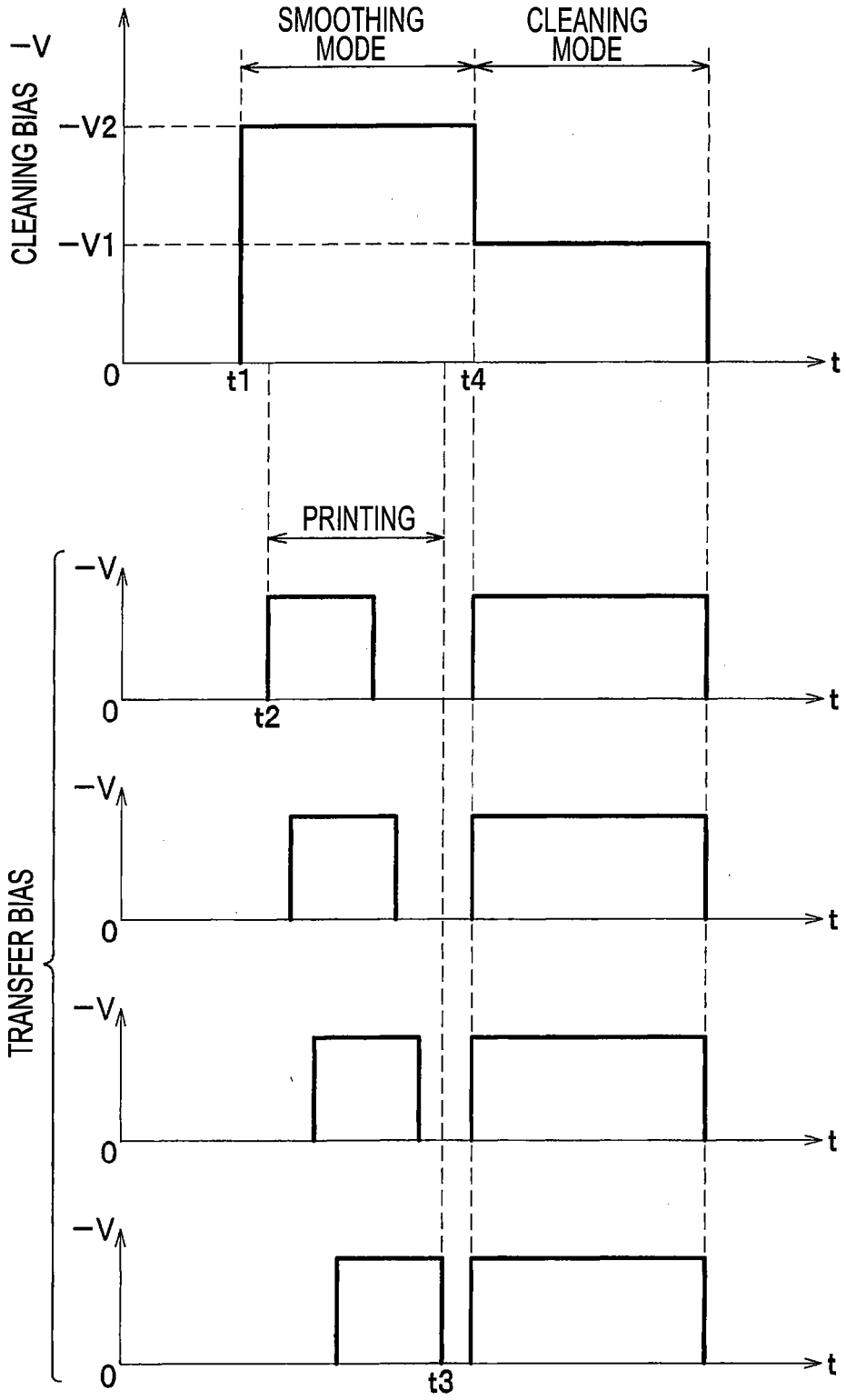
FIG. 3 is a time chart showing a cleaning bias and a transferring bias.

Next, the control unit 100 as a feature portion of the present invention will be explained in detail hereunder. Out of the referred figures, FIG. 3 is a time chart showing a cleaning bias and a transferring bias, and FIGS. 4A to 4D are explanatory views showing an operation of smoothing an uneven charge distribution on the belt. Also, FIG. 5 is a flowchart showing an operation of the control unit.

The control unit 100 is constructed such that a cleaning mode (first mode), in which the toner adhered onto the outer peripheral surface of the belt 73 is attracted to the cleaning roller 112, and a smoothing mode (second mode), in which the distribution of charges on the belt 73 is made uniform, can be executed by controlling the voltage applied to the cleaning roller 112. Concretely, the control unit 100 executes the cleaning mode by applying a predetermined voltage to the cleaning roller 112, and executes the smoothing mode by applying a voltage different from the predetermined voltage to the cleaning roller 112. In the following explanation, the voltage applied to the cleaning roller 112 is also called a "cleaning bias" irrespective of a value of the voltage.

In the present embodiment, as shown in FIG. 3, the cleaning bias has the negative polarity (same polarity) in the cleaning mode and the smoothing mode respectively. Then, the cleaning bias in the cleaning mode is set to a negative bias "−V1" that is decided by considering the charges of the toner, etc., and the cleaning bias in the smoothing mode is set to a negative bias "−V2" whose absolute value is larger than the negative bias "−V1" in the cleaning mode.

A detailed explanation about the control of the transfer bias shown in FIG. 3 will be omitted because this control is publicly known, but simple explanation will be given hereunder. As shown in FIG. 3, in the printing control, the transfer bias is applied sequentially to four transfer rollers 74 from the upstream side in the carrying direction of the paper P respectively, so that the transferring operation is made sequentially by respective transfer rollers 74. Also, in the cleaning mode, the transfer bias is applied simultaneously to four transfer rollers 74, so that the toner returned from respective drum cleaners 54 on respective photosensitive drums 53, etc. are discharged simultaneously onto the belt 73. Also, for convenience of explanation, a state of the transfer bias applied when the printing is made on a sheet of paper P is illustrated in FIG. 3.

Then, in addition to various controls applied to execute printing on the papers in response to a printing command after the control unit received the printing command, for example, for example, execute the foregoing cleaning mode after the printing is ended, etc., the control unit 100 always executes the smoothing mode during the printing. Specifically, the control unit 100 starts the smoothing mode at the tie t1 prior to a time t2 at which the printing is started (time t1), and terminates the smoothing mode at a time t4 after a predetermined time has elapsed since a time t3, the time at which the printing ended (time t4).

Figure 4:
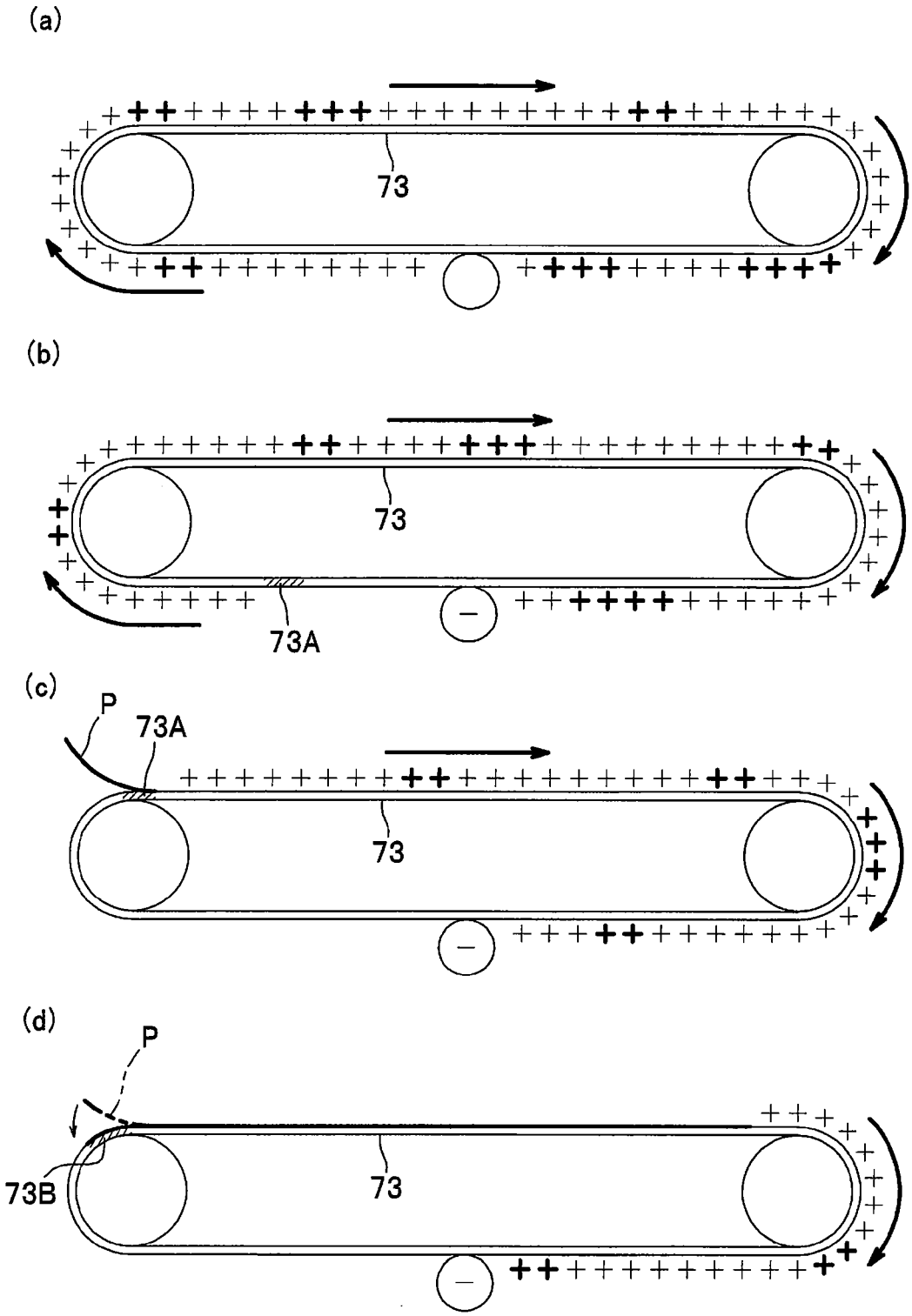
FIGS. 4A to 4D are explanatory views showing an operation of smoothing an uneven charge distribution on a belt.
Figure 5:
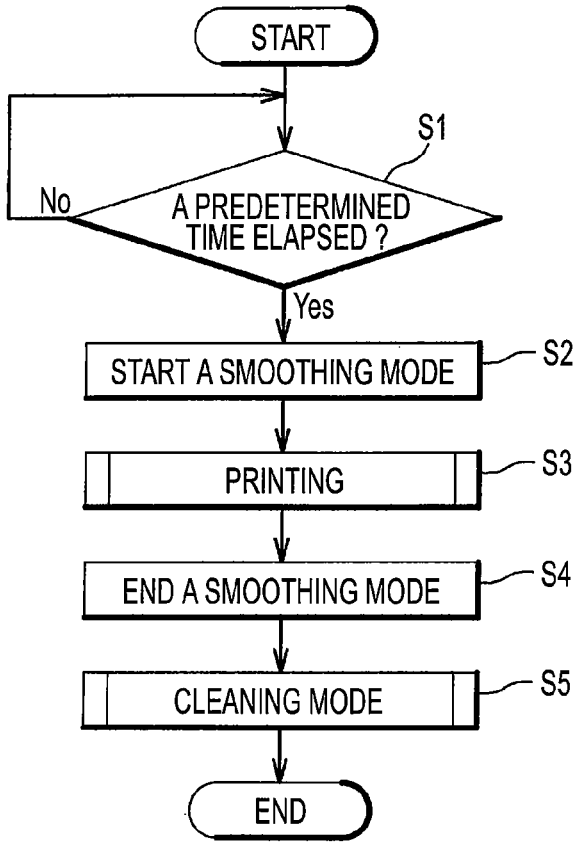
FIG. 5 is a flowchart showing an operation of a control unit.

In more detail, as shown in FIGS. 4A to 4D, the control unit 100 starts the smoothing mode before a top end of the paper P contacts the belt 73 in such a manner that, when the top end of the paper P fed from the upstream side in the carrying direction of the belt 73 comes in contact with the belt 73, a distribution of charges in a part 73A of the belt 73, which contacts the top end of the paper P, has already been smoothed (see FIG. 4B).

Here, a mark "+" shown in FIGS. 4A to 4D denotes the charges accumulated on the belt 73, and a difference in an amount of charge is indicated by a thickness of the line. Also, a portion of the belt 73, from which "+" is removed, denotes a state that an uneven distribution of charges has been smoothed.

As shown in FIG. 4D, the control unit 100 continues the smoothing mode at least for a predetermined time in such a manner that, when a rear end of the paper P fed from the upstream side in the carrying direction of the belt 73 gets on the belt 73, a distribution of charges in a part 73B of the belt 73, which contacts the rear end of the paper P, has already been smoothed.

Specifically, the control unit 100 operated in compliance with a flowchart shown in FIG. 5.

As shown in FIG. 5, when the control unit 100 receives the printing command (START), the control unit 100 first decides whether or not a predetermined time has elapsed (S1). In this case, a predetermined time in step S1 is set to a time shorter than a value obtained by subtracting the time, at which the first part 73*a* of the belt to be smoothed (see FIG. 4B) arrives at an entering position of the paper P (see FIG. 4C), from a time, at which the top end of the paper comes in contact with the belt 73 after the printing command is issued. Here, a predetermined time in step S1 can be decided appropriately based on experiment, simulation, or the like.

In step S1, if a predetermined time has elapsed (Yes), the control unit 100 starts the smoothing mode (S2). That is, as shown in FIG. 3, a negative cleaning bias "−V2" whose absolute value is large is applied to the cleaning roller 112 at a time t1. Accordingly, when the belt 73 is charged unevenly in the preceding cleaning mode, as shown in FIG. 4A, the uneven distribution of charges on the belt 73 is smoothed gradually by the cleaning roller 112 to which the negative cleaning bias "−V2" whose absolute value is large is applied, as shown in FIG. 4B.

After step S2, the control unit 100 initiates the printing (S3). After the printing in step S3 has ended, the control unit 100 terminates the smoothing mode (S4). After step S4, the control unit 100 decreases the cleaning bias from "−V2" to "−V1" (see FIG. 3) and executes the cleaning mode (S5). Accordingly, in the cleaning mode, the cleaning operation is executed effectively, while suppressing the degradation of the belt 73.

According to the above, advantages described hereunder can be achieved in some embodiment of the present invention. However, embodiments of the present invention need not achieve these or any of the advantages.

A cleaning bias suitable for the cleaning can be applied in the cleaning mode, while the bias can be switched to a cleaning bias suitable for the smoothing in the smoothing mode. Therefore, the smoothing and the cleaning can be executed satisfactorily, while suppressing the degradation of the belt 73.

The distribution of charges in the part 73A of the belt 73, which contacts the top end of the paper P that is fed from the upstream side of the belt 73, has already been smoothed. Therefore, an amount of charges near the top end of the paper P can be suppressed, and the release discharge caused when the paper P is released from the belt 73 can be suppressed.

When the rear end of the paper P that is fed from the upstream side of the belt 73 gets on the belt 73, the distribution of charges in the part 73B of the belt 73, which contacts the rear end of the paper P, has already been smoothed. Therefore, an amount of charges on the whole paper P can be suppressed in small amount, and the release discharge can be suppressed satisfactorily.

However, embodiments of the present invention are not limited to the above embodiment, and various modes can be utilized as illustrated in the following.

In the above embodiment, the smoothing mode is executed during the printing that is executed prior to the cleaning mode. But the present invention is not limited to this embodiment, and the smoothing mode may be executed after the cleaning mode is ended. That is, as shown in FIG. 6 and FIG. 7, the control unit may be constructed to execute the respective modes in order of a printing mode (S11), a cleaning mode (S12), and a smoothing mode (S13).

According to this, the distribution of charges accumulated unevenly on the belt surface by the printing or the cleaning mode can be collectively smoothed last. Therefore, in the smoothing mode, the distribution of charges on the whole surface of the belt is smoothed when the belt goes around once after the cleaning bias is changed to the voltage "−V2" whose absolute value is large. As a result, merely a time in which the belt goes around once is required as a time during which the voltage "−V2" is applied. That is, in this mode, a time in which a high voltage should be applied to the belt can be shortened in contrast to the above embodiment (the mode in which the smoothing mode is always executed during the printing), and the degradation of the belt can be suppressed even more.

Figure 7:
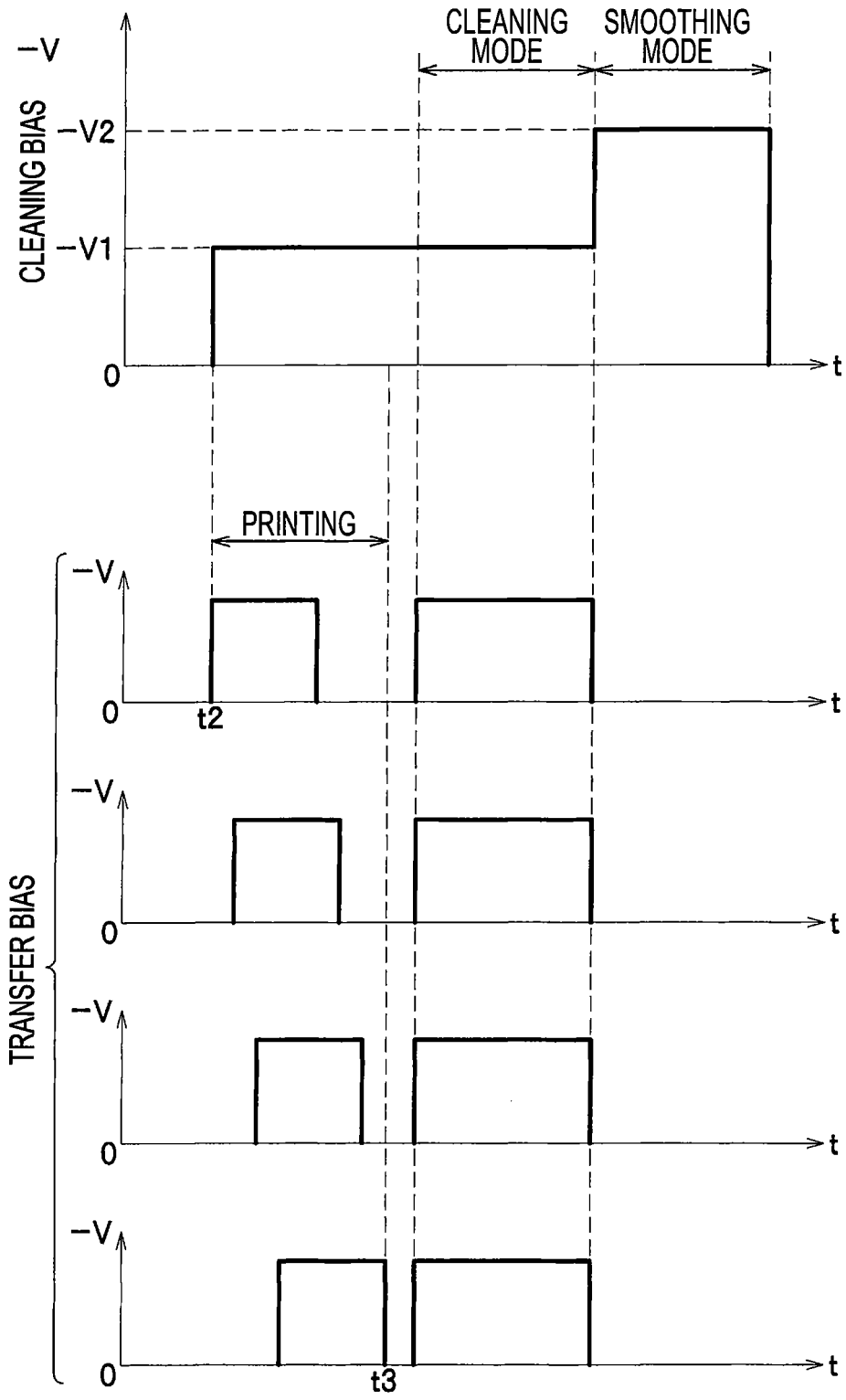
FIG. 7 is a time chart showing a cleaning bias and a transferring bias when the control is applied based on a flow in FIG. 6.

As shown in FIG. 7, it is preferable that the same bias as the cleaning bias in the cleaning mode should always be applied to the cleaning roller during the printing. According to this, since the cleaning bias is applied to the cleaning roller during the printing, the toner adhered onto the belt during the printing, and the like can be recovered satisfactorily by the cleaning roller. However, embodiments of the present invention are not limited to the embodiment of FIG. 7. A time at which the cleaning mode is executed (a time at which the cleaning bias is applied in the cleaning mode) may be set to any time after the end of the printing. For example, the application of the cleaning bias may be started after the end of the printing.

Figure 6:
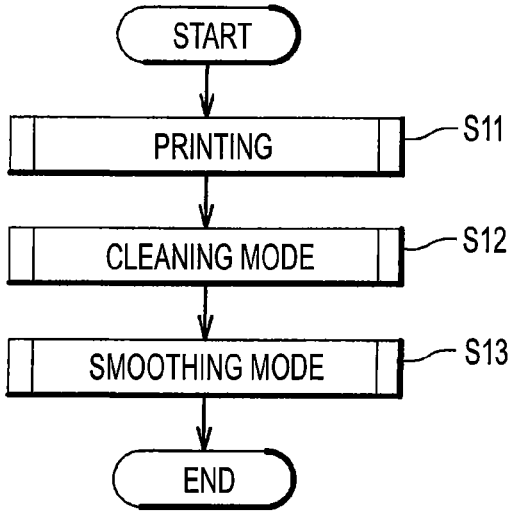
FIG. 6 is a flowchart showing a mode in which a smoothing mode is executed after a cleaning mode.
Figure 8:
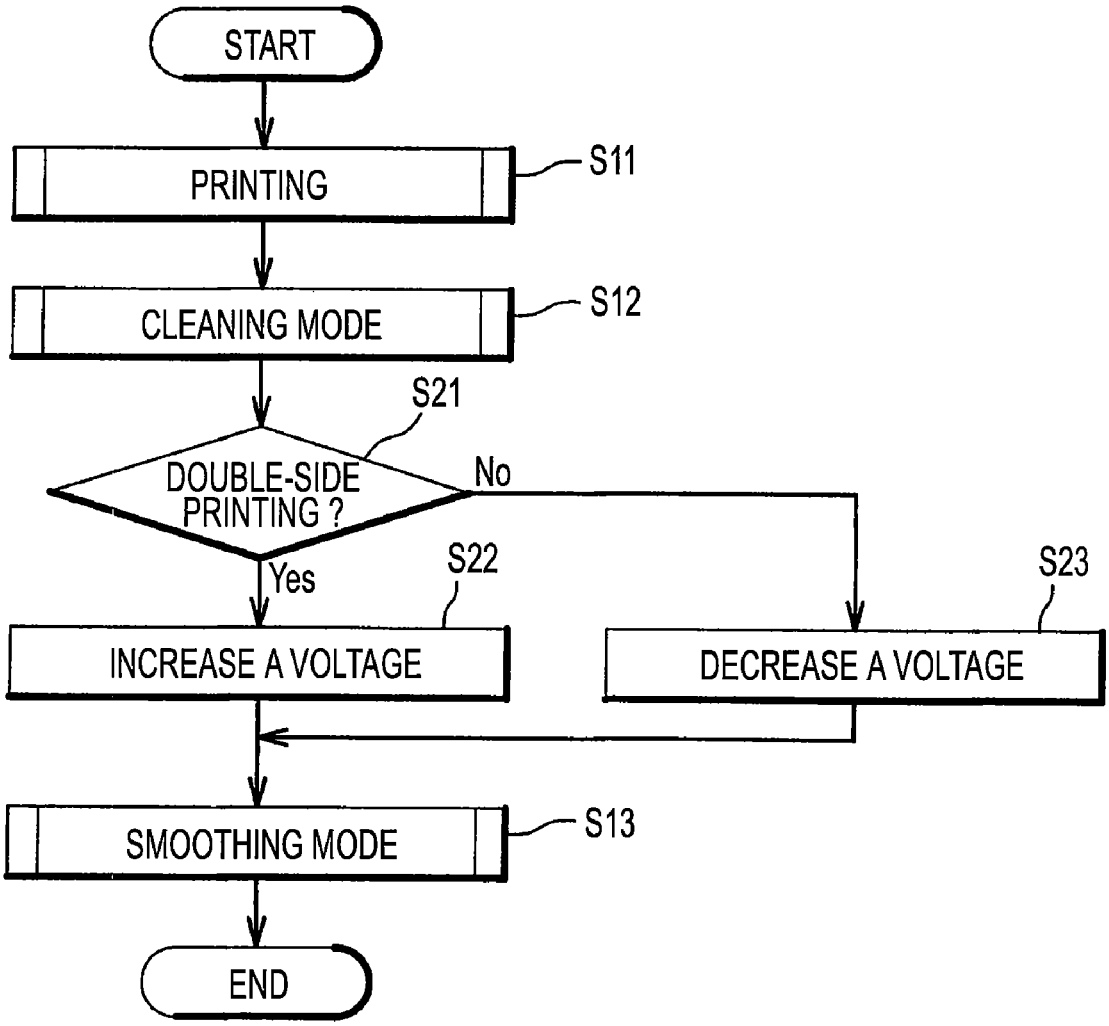
FIG. 8 is a flowchart showing a mode in which a voltage in the smoothing mode is changed in response to whether or not the double-side printing is applied.

In the embodiment in which the control is applied in order of the printing, the cleaning mode, and the smoothing mode as shown in FIG. 6, a voltage in the smoothing mode may be changed in response to whether or not the printing command indicates double-side printing, as shown in FIG. 8. In this case, the control unit decides whether or not the printing command indicates double-side printing (S21) after the cleaning mode has ended (S12).

Figure 9:
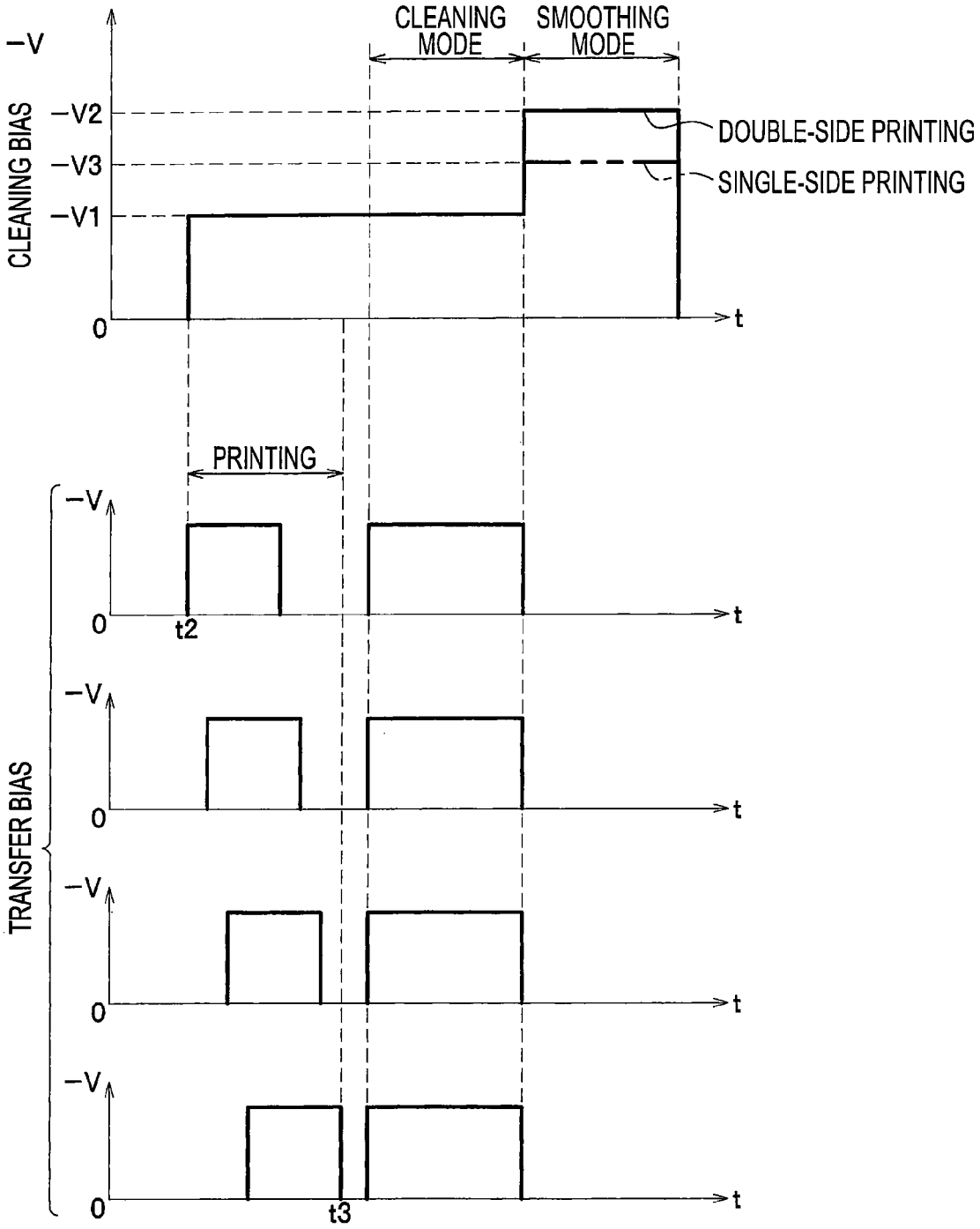
FIG. 9 is a time chart showing a cleaning bias and a transferring bias when the control is applied based on a flow in FIG. 8.

In step S21, if the control unit has decided that the printing command indicates double-side printing (Yes), the control unit sets the cleaning bias in the smoothing mode to the higher voltage "−V2" shown in FIG. 9 (S22). Alternatively, in step S21, if the control unit has decided that the printing command does not indicate the double-side printing, i.e., indicates the single-side printing (No), the control unit sets the cleaning bias in the smoothing mode to a voltage "−V3" whose absolute value is smaller than the voltage "−V2" shown in FIG. 9 but larger than the voltage "−V1" in the cleaning mode (S23).

That is, the control unit is constructed such that, if it receives the command for the double-side printing (S21; Yes), the absolute value of the voltage in the smoothing mode is increased higher than the value when it receives the command for the single-side printing (S21; No). Also, after steps S22, S23, the control unit executes the smoothing mode at the voltage being set in steps S22, S23 (S13).

In the case of double-side printing, the paper P passes through the fixing unit 80 (see FIG. 1) once and then the printing of the back surface is applied after the printing on the front surface of the paper P is completed. Therefore, the paper P is dried by a heat of the fixing unit 80, and this paper P is brought into an easily charged condition. As a result, an amount of charge of the paper P is increased by the transfer bias applied when the printing is applied to the back surface of this dried paper P, and correspondingly an amount of charge of the belt is increased. That is, an amount of charge of the belt in the double-side printing after the printing is completed becomes larger than that in the single-side printing.

Therefore, as shown in FIGS. 8 and 9, the voltage "−V2" in the double-side printing is set higher than the voltage "−V3" in the single-side printing. At this time, in the case of the single-side printing in which an amount of charge of the belt is small, a distribution of charges can be smoothed satisfactorily at the lower voltage "−V3" and, in the case of the double-side printing in which an amount of charge of the belt is large, a distribution of charges can be smoothed satisfactorily at the higher voltage "−V2". Also, the higher voltage "−V2" is not applied to the belt in the single-side printing, and thus the degradation of the belt can be suppressed correspondingly.

Figure 10:
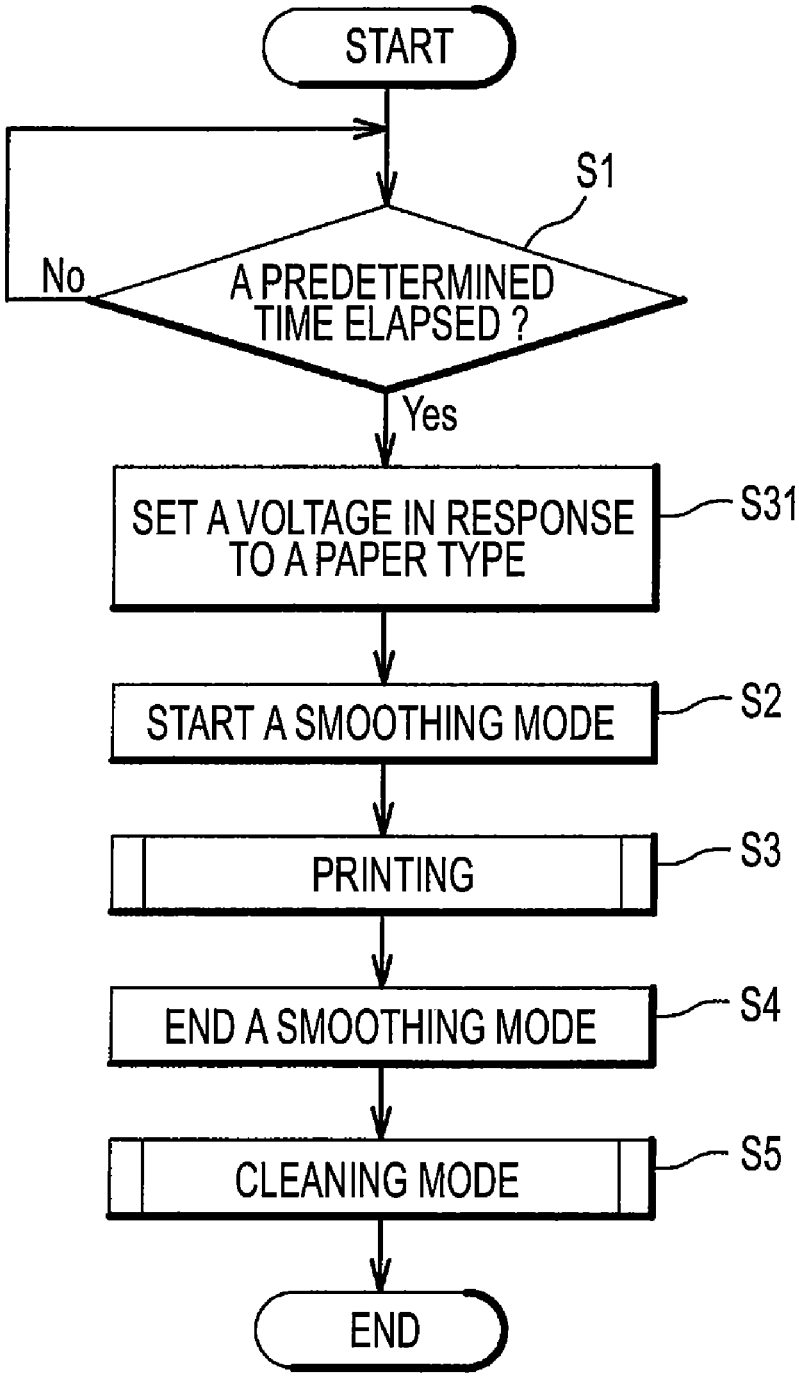
FIG. 10 is a flowchart showing a mode in which the step of changing a voltage in the smoothing mode in response to the type of a paper is added to the flow in FIG. 5.
Figure 11:
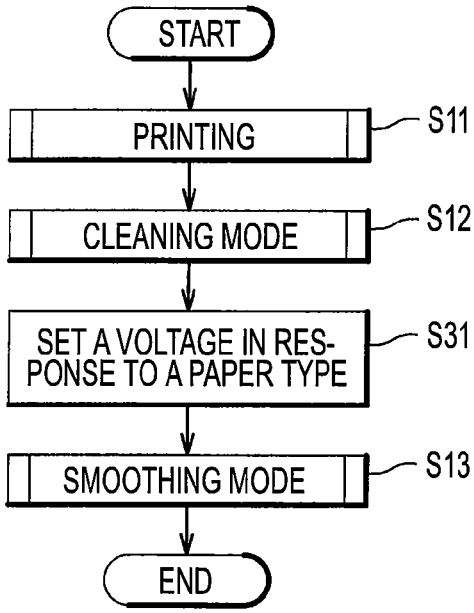
FIG. 11 is a flowchart showing a mode in which the step of changing a voltage in the smoothing mode in response to the type of a paper is added to the flow in FIG. 6.

Also, as shown in FIG. 10 and FIG. 11, the control unit may be constructed to change a voltage in the smoothing mode in response to the type of the paper. Here, FIG. 10 shows a flow in which a new step S31, in which a voltage is set in response to the type of the paper contained in the printing command, is provided between step S1 and step S2 of the flow previously shown in FIG. 5. FIG. 11 shows a flow in which this new step S31 is provided between step S12 and step S13 in the flow previously shown in FIG. 6.

According to this, even when an amount of charge is different depending on the type of the paper, the voltage in the smoothing mode is changed in response to this amount of charge. Therefore, the smoothing can be applied satisfactorily no matter which type of paper should be printed.

Figure 12:
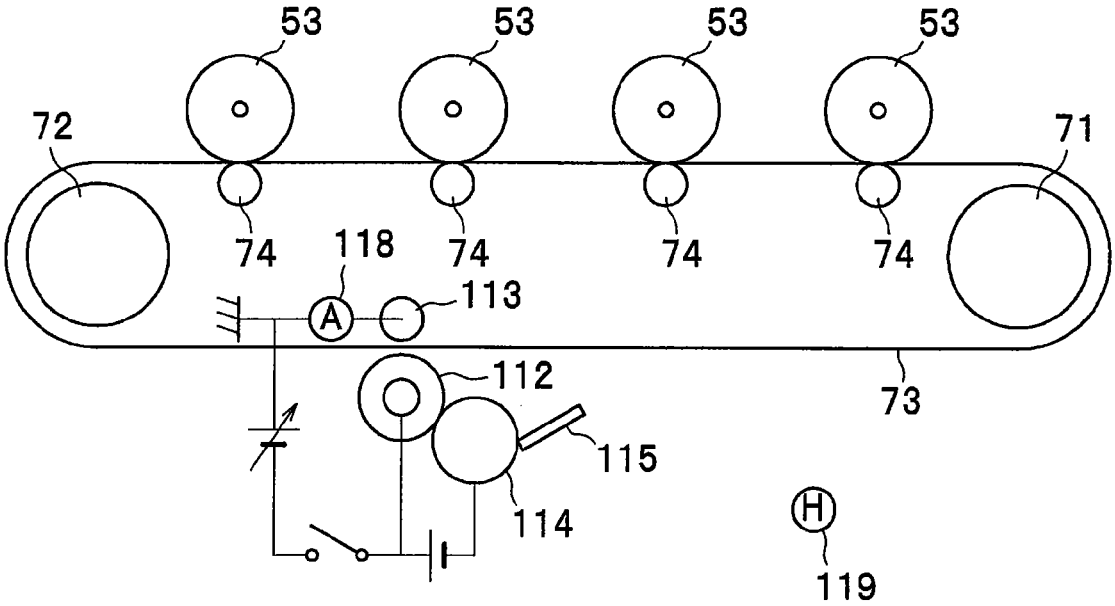
FIG. 12 is an explanatory view showing a mode in which an ampere meter and a humidity sensor are provided.

As shown in FIG. 12, an ampere meter 118 may also be provided to the circuit that applies a voltage to the cleaning roller 112, etc., as a type of a current sensor that senses a current passing through the cleaning roller 112, the belt 73, and the backup roller 113. Alternatively, a sensor for sensing a voltage directly may be employed as the current sensor.

In this embodiment, the voltage in the smoothing mode may be controlled such that the current sensed by the ampere meter 118 is within a predetermined range. Accordingly, the distribution of charges can be smoothed satisfactorily.

In the embodiment shown in FIG. 12, a humidity sensor 119 for sensing a humidity in the apparatus main further body may be provided. In this case, various types of sensors such as a wet and dry hygrometer, a dew point type hygrometer, and the like may be employed as the humidity sensor 119.

When the humidity sensor 119 is provided in this manner, the control unit may change a voltage in the cleaning mode within a predetermined range, based on a humidity sensed by the humidity sensor 119 and an electric current sensed by the ampere meter 118. That is, the control unit may be constructed to control a voltage in the cleaning mode within a predetermined range.

Specifically, the voltage in the cleaning mode may be decided by using a table like the table shown in FIG. 13. In FIG. 13, current values A1 to A4 and humidity values H1 to H4 are increased as a numeric value attached to the references A, H respectively becomes larger. Also, absolute values of voltages −V11 to −V16 in the cleaning mode are increased as a numeric value attached to the references −V respectively becomes smaller.

That is, according to the table in FIG. 13, the voltage values whose absolute value is smaller are chosen as the sensed current value and the sensed humidity increases. Specifically, for example, when the humidity sensed by the humidity sensor 119 is in a range of H1 to H2 and the current value sensed by the ampere meter 118 is in a range of A1 to A2, the voltage in the cleaning mode is decided as "−V 12" by using the table in FIG. 13.

According to this, the voltage in the cleaning mode can be decided based on the humidity sensed by the humidity sensor 119 and the current value sensed by the ampere meter 118. Therefore, the cleaning can be executed satisfactorily by taking the influence of the humidity and the electric current into consideration.

In the above embodiment, the cleaning bias is set to be "negative" because the toner and the outer surfaces of the belt are charged the "positive". But embodiments of the present invention need not be limited to this. When the toner and the outer surfaces of the belt are charged to be "negative", the cleaning bias may be set to be "positive".

In the above embodiment, the absolute value of the voltage in the smoothing mode is set larger than the voltage in the cleaning mode. But embodiments of the present invention need not be limited to this. Since a charging state of the belt changes depending on the material of the belt, etc., the absolute value of the voltage in the smoothing mode may be set smaller than the voltage in the cleaning mode depending on the specific configuration used.

The absolute value of the voltage in the smoothing mode can be set arbitrarily at any level at which the distribution of charges on the belt should be smoothed. For example, the distribution of charges may be set to almost zero, for example. In this example, the charge of the belt is completely eliminated.

Also, even though the distribution of charges on the belt is not smoothed completely to a particular numeric value, the smoothing may be applied to such an extent that the distribution of charges on the belt is made somewhat smooth. In other words, the "smoothing" in the present specification is not limited to such a situation that the distribution of charges on the belt is smoothed (made uniform) completely to a particular numeric value, but also signifies such a situation that respective charges are made uniform at numeric values that are close to each other to some extent.

In the embodiment shown in the flow in FIG. 5, the smoothing mode is started after a predetermined time has elapsed from the reception of the printing command. But embodiments of the present invention are not limited to this. For example, when such a control is applied that the paper is stopped once by the resist roller before the paper is carried onto the belt, a start time of the smoothing mode may be decided by using a timing at which the conveyance of the paper is started by the resist roller, as a starting point.

Further, when a predetermined long time has elapsed from the end of the preceding printing command, or when the first printing command is received after the power is turned ON, or the like, it is possible that the uneven distribution of charges on the belt is smoothed by the time dependent change. Therefore, in this case, the smoothing mode in FIG. 5 may not be executed.

In the above embodiment, the present invention is applied to the color printer 1. But embodiments of the present invention are not limited to this. The present invention may be applied to other image forming apparatuses, e.g., a copying machine, a multifunction machine, and the like.

In the above embodiment, the paper P such as a thick paper, a postcard, a thin paper, or the like is employed as an example of the recording sheet. But the present invention is not limited to this. For example, an OHP sheet may be employed.

In the above embodiment, the photosensitive drum 53 is employed as the photosensitive body. But embodiments of the present invention are not limited to this. For example, a belt-like photosensitive body may be employed.

In the above embodiment, the transfer roller 74 is employed as the transferring member. But embodiments of the present invention are not limited to this. A member that is not formed like the roller may be employed.

In the above embodiments, the cleaning roller 112 and the backup roller 113 are employed as the cleaning member. But embodiments of the present invention are not limited to this. A member that is not formed like the roller may be employed.

In the above embodiments, the image forming apparatus in which the toner image formed on the photosensitive drum is transferred onto the recording sheet by the transferring member while the carrying surface of the belt carries the recording sheet. But embodiments of the present invention are not limited to this. An image forming apparatus in which the toner image formed on the photosensitive drum is transferred onto a carrying surface of an intermediate transfer belt by a first transferring member, and the toner image transferred on the intermediate transfer belt is transferred onto the recording sheet by a second transferring member while the recording sheet is fed between the intermediate transfer belt and the second transferring member may be employed.

What is claimed is:

1. An image forming apparatus, comprising:

a belt having a carrying surface configured to carry a recording sheet;

a photosensitive body disposed opposite to the carrying surface of the belt;

a transferring member which is disposed opposite to the photosensitive body such that the carrying surface of the belt is disposed between the transferring member and the photosensitive body, and a transferring bias is applied to the transferring member;

a cleaning member arranged adjacent to an outer peripheral surface of the belt; and a control unit configured to control a voltage that is applied to the cleaning member, wherein the control unit causes a first voltage to be applied to the cleaning member during a first mode and wherein the control unit causes a second voltage, different from the first voltage, to be applied to the cleaning member during a second mode, wherein in the first mode, the control unit applies the first voltage to the cleaning member, which attracts a developing agent being adhered onto a belt surface to the cleaning member, and wherein in the second mode, the control unit applies the second voltage to the cleaning member, which smooths a distribution of charges on the belt surface.

2. The image forming apparatus according to claim 1, wherein the control unit is configured to execute the second mode before a top end of the recording sheet fed from an upstream side of a carrying direction contacts the belt such that a distribution of charges in a part of the belt, which contacts the top end of the recording sheet, has already been smoothed.

3. The image forming apparatus according to claim 2, wherein the control unit continues executing the second mode at least for a predetermined time such that, when a rear end of the recording sheet, which is fed from the upstream side in the carrying direction of the belt, comes into contact with the belt, a distribution of charges in a part of the belt, which contacts the rear end of the paper, has already been smoothed.

4. The image forming apparatus according to claim 1, wherein the control unit is configured to execute the first mode after a printing on the recording sheet is ended, and configured to execute the second mode after the first mode is ended.

5. The image forming apparatus according to claim 4, wherein, when a double-side printing command is received, the control unit increases an absolute value of the second voltage in the second mode to a value greater than an absolute value of the second voltage used when the control unit receives a single-sided printing command.

6. The image forming apparatus according to claim 1, wherein the control unit is configured to change the voltage in the second mode in response to a type of the recording sheet.

7. The image forming apparatus according to claim 1, further comprising:

a current sensor configured to sense an electric current flowing through the cleaning member and the belt;

wherein the control unit is configured to control the second voltage used in the second mode such that the electric current sensed by the current sensor is within a predetermined range.

8. The image forming apparatus according to claim 7, wherein the control unit is configured to control a predetermined voltage within a predetermined range in the first mode.

9. The image forming apparatus according to claim 8, further comprising:

a humidity sensor configured to sense humidity in an apparatus main body;

wherein the control unit is configured to change the predetermined voltage based on the humidity sensed by the humidity sensor and the electric current sensed by the current sensor.

10. An image forming apparatus according to claim 1, wherein the voltage applied to the cleaning member has a same polarity in the first mode and the second mode, and an absolute value of the voltage in the second mode is set larger than an absolute value of the voltage in the first mode.

11. A method of controlling an image forming apparatus which comprises a belt having a carrying surface; a photosensitive body disposed opposite to the carrying surface of the belt; a first transferring member which is disposed opposite to the photosensitive body such that the carrying surface of the belt is disposed between the first transferring member and the photosensitive body, and a transferring bias is applied to the first transferring member; a cleaning member arranged adjacent to an outer peripheral surface of the belt; and a control unit for controlling a voltage that is applied to the cleaning member, the method comprising:

receiving a printing command;

starting a smoothing mode in which the control unit causes a voltage to be applied to the cleaning member after a predetermined time has elapsed since reception of the printing command;

initiating printing after starting the smoothing mode;

terminating the smoothing mode after the printing ends; and executing a cleaning mode in which the control unit causes a voltage, different from the voltage of the smoothing mode, to be applied to the cleaning member.

* * * * *